US006296543B1

(12) United States Patent
Andrews

(10) Patent No.: US 6,296,543 B1
(45) Date of Patent: Oct. 2, 2001

(54) TOY FIGURE HAVING ENHANCED PUNCHING FEATURE

(75) Inventor: Michael Andrews, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 09/632,118

(22) Filed: Aug. 3, 2000

(51) Int. Cl.[7] ..... A63H 13/06

(52) U.S. Cl. ..... 446/334; 446/297; 446/298; 446/4; 446/390; 446/485; 446/336

(58) Field of Search ..... 446/297, 298, 446/330, 331, 334, 336, 320, 333, 335, 353, 354, 485, 4, 390

(56) References Cited

U.S. PATENT DOCUMENTS

| | | | | |
|---|---|---|---|---|
| 2,310,037 | * | 2/1943 | Reno . | |
| 3,947,994 | * | 4/1976 | Meyer et al. . | |
| 3,977,292 | * | 8/1976 | Favilli et al. . | |
| 4,601,672 | * | 7/1986 | Cook et al. | 446/330 |
| 4,738,649 | * | 4/1988 | Delli Bovi et al. | 446/336 |
| 4,820,229 | * | 4/1989 | Spraggins | 446/26 |
| 5,267,886 | * | 12/1993 | Wood et al. | 446/175 |
| 5,466,181 | * | 11/1995 | Bennett et al. | 446/297 |
| 5,738,526 | * | 4/1998 | Cerda | 434/304 |
| 6,053,797 | * | 7/1998 | Tsang et al. | 446/297 |
| 6,139,394 | * | 11/1999 | Maxim | 446/219 |
| 6,142,846 | * | 10/1999 | Ojakaar | 446/72 |

* cited by examiner

*Primary Examiner*—Jacob K. Ackun, Jr.
*Assistant Examiner*—Bena B. Miller
(74) *Attorney, Agent, or Firm*—Roy A. Ekstrand

(57) ABSTRACT

A toy figure includes a body having an upper torso pivotally coupled to a lower torso. The lower torso is coupled to a pair of supporting-legs while the upper torso is coupled to a pair of pivotally supported arms. A head is further supported upon the upper torso. The upper torso includes a spring pivot allowing the upper torso to be pivoted approximately ninety degrees with respect to the lower torso. When pivoted and released, the upper torso rapidly pivots back to its original alignment imparting a punching motion to one of the toy figures arms. A switch is supported within the punching arm of the toy figure together with a flash element and a light emitting diode. A control circuit within the toy figure torso responds to actuation of the switch to produce a crash-type sound and to energize the flash element to provide a simultaneous burst of bright light.

10 Claims, 3 Drawing Sheets

14
21
41
11
20
10
19
17
42
36
15
40
12
24
3
3
22
25
50
18
23
13
51
16
50
31
30
33
32

TOY FIGURE HAVING ENHANCED PUNCHING FEATURE

FIELD OF THE INVENTION

This invention relates generally to toy figures and particularly of the type known in the art as "action figures".

BACKGROUND OF THE INVENTION

Toy action figures have become an extremely popular and well known type of product in the toy arts. Directed largely to young boys, these toy figures typically replicate male oriented hero's and villain's and the like. Common themes for such action figures include warriors, soldiers, athletes and the like. In addition, many action figures have been provided which utilize a science fiction theme such as robots, cyborgs, androids and superheros.

While the appearances and physical size as well as other properties may very substantially among toy action figures, most action figures may be generalized to include a molded plastic body often exaggerated in proportion and musculature. Most of the molded plastic bodies of action figures are fabricated of a plurality of parts and components joined by a corresponding plurality of articulated joints. The overall effect is often intended to provide posing or movement similar to that experienced by humans. Posability, that is to say the ability to maintain a particular body position, is usually obtained by providing a friction-fit at one or more of the multiple articulated joints.

Many action figures also provide certain movement features to further enhance the play value of the toy figure. Such movement features may, for example, include an ability to jump, punch or kick. In many instances accessories such as various shields and weapons are also provided for use in combination with action figures.

The more recent advances in miniaturized low-cost digital electronic systems have enabled practitioner's in the toy art to further enhance action figures with sound circuitry supported within the figure. The objective of such sound circuitry is to provide action enhancement through sound effects such as speech or other sounds which may, for example, include thunder, other loud noises or crashing sounds.

Despite substantial success in the market place on the part of such action figures, there remains nonetheless a continuing need in the art for ever more improved, interesting and exciting toy action figures.

SUMMARY OF THE INVENTION

Accordingly, it is a general object of the present invention to provide an improved toy action figure. It is a more particular object of the present invention to provide an improved toy action figure having enhanced punching features.

In accordance with the present invention there is provided a toy figure comprising: a toy figure body having at least one arm, an upper torso and a lower torso, the upper torso being pivotable upon the lower torso between first and second positions; a spring coupled to the upper and lower torso urging the upper torso toward the first position; a sound circuit for producing an audible sound; a flash unit and flash element supported within the at least one arm for producing a burst of light; a hand movably supported upon the at least one arm; and an impact switch coupled to the sound circuit and the flash unit supported within the at least one arm, the impact switch being actuated by movement of the hand to activate the sound circuit and the flash unit, the upper torso being pivoted against the force of the spring from the first position to the second position and released to rapidly pivot the upper torso and move the at least one arm in a punching motion to impact the hand against an object and actuate the impact switch.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
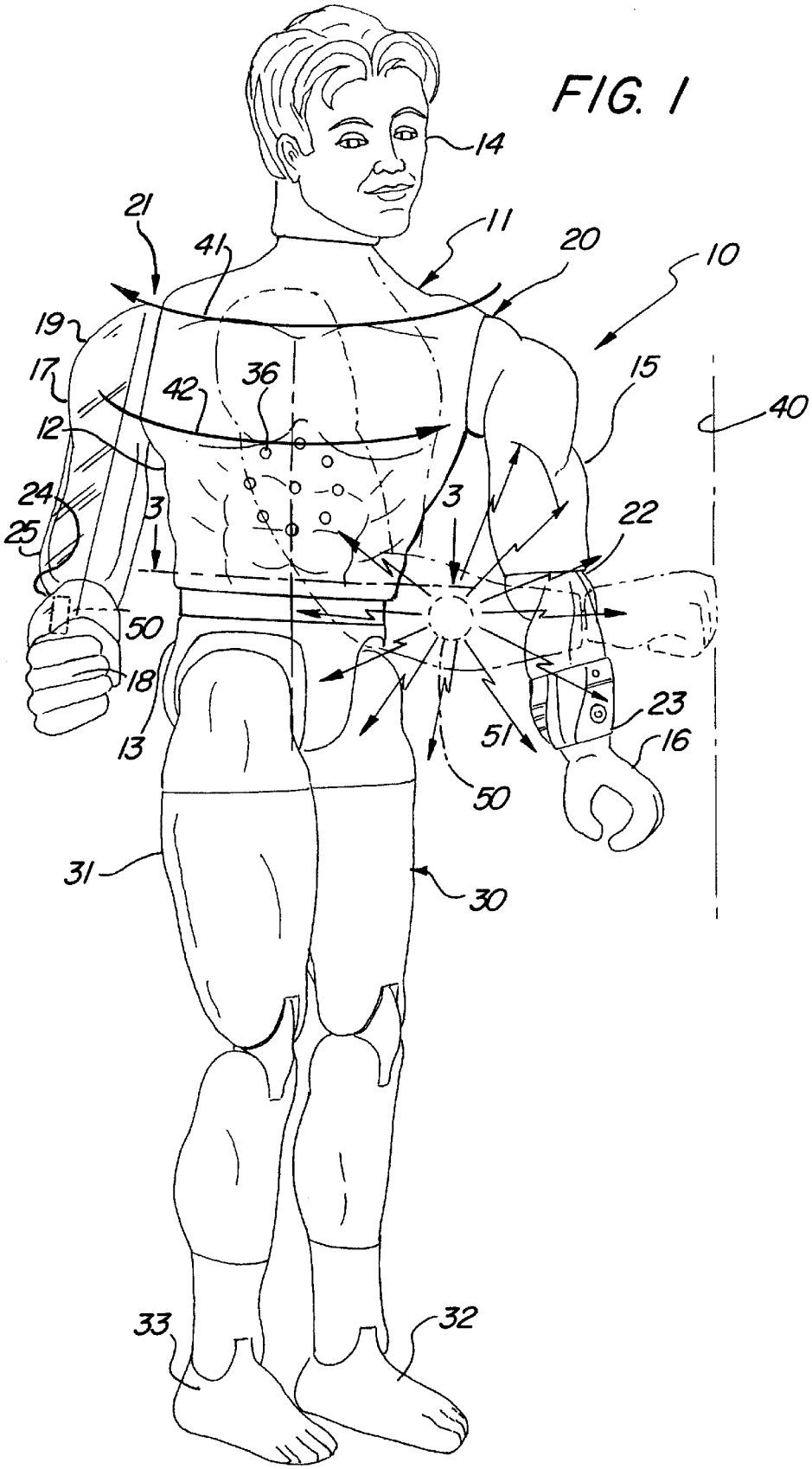
FIG. 1 sets forth a perspective view of a toy action figure constructed in accordance with the present invention.

FIG. 1 sets forth a front perspective view a toy figure constructed in accordance with the present invention and generally referenced by numeral 10. Toy FIG. 10 includes a body 11 fabricated of a plurality of molded plastic components. Thus, body 11 includes an upper torso 12 pivotally secured to a lower torso 13. Lower torso 13 in turn supports legs 30 and 31 having feet 32 and 33 secured thereto. A pair of arms 15 and 17 supporting respective hands 16 and 18 are pivotally secured to upper torso 12 by a pair of shoulder joints 20 and 21. Upper torso 12 further supports a speaker grille 36 on the front portion thereof. Arm 17 includes a clear portion 19 generally covering the outer portion thereof, an elbow 24 and a wrist 25. Arm 15 includes an articulated elbow joint 22 and wrist 23.

In operation, and by means set forth below in greater detail, the combined structure of upper torso 12, arms 15 and 17 and head 14 is pivotally secured to lower torso 13. This pivotal attachment is set forth below in greater detail in FIG. 32. Suffice it to note here, that upper torso 12 is pivotable in the direction indicated by arrow 41 through a range of movement approximately equal to ninety degrees. By means also better seen below in FIG. 3, the pivoting movement of upper torso 12 in the direction of arrow 41, is carried forward in opposition to a return spring (spring 95 in FIG. 3). Thus, as upper torso 12 is pivoted in the direction of arrow 41, energy is stored within the spring and upon release of upper torso 12 while holding lower torso and/or legs 30 and 31 the stored energy within spring 95 (seen in FIG. 3) rapidly pivots upper torso 12 in the direction indicated by arrow 42 returning upper torso 12 to the alignment with lower torso 13 shown in FIG. 1.

In accordance with the present invention, and as is set forth below in FIG. 2 in greater detail, arm 17 defines an interior cavity (cavity 70 seen in FIG. 2) within which a plurality of circuit components including a flash element 50 which by means set forth below in greater detail, is activated producing a strobe-light flash of light each time hand 18 impacts a suitable object. Thus, for purposes of illustration, FIG. 1 shows arm 17 rotated in the direction indicated by arrow 42 causing hand 18 to impact a surface 40. By means set forth below in greater detail, this impact energizes flash unit 50 producing a burst of bright light indicated by light rays 51 in FIG. 1.

Concurrent with the energizing of flash unit 50 and its flash of high-energy light output, an internal sound circuit (sound circuit 80 seen in FIG. 2) operative within upper torso 12 produces a suitable sound output which is directed outwardly through speaker grille 36. The nature of sound output may be selected in accordance with preference. However, in the embodiment shown in FIG. 1, a sound output which simulates a crashing sound has been selected.

Thus, the user manipulates toy FIG. 10 by initially grasping lower torso 13 and/or legs 30 and 31 with one hand while positioning toy FIG. 10 in proximity to a to-be-punched object or surface such as surface 40 and thereafter pivots the combined structure of upper torso 12, arms 15 and 17 and head 14 in the direction indicated by arrow 41 and thereafter releases upper torso 12 allowing a rapid pivoting movement in the direction of arrow 42. This rapid pivoting movement causes arm 17 and hand 18 to move in a punching motion toward the targeted object or surface. In the example of surface 40, the user continues to adjust the position of toy FIG. 10 during the rapid pivoting movement of upper torso 12 in the direction of arrow 42. This adjustment is undertaken to ensure that hand 18 impacts the target surface. By means set forth below in greater detail, the impact of hand 18 against the target surface, such as surface 40, causes flash unit 50 to be energized and causes the above mentioned crash sound to be produced. The result is an entertaining and amusing enhancement of a punch feature within toy FIG. 10.

Figure 2:
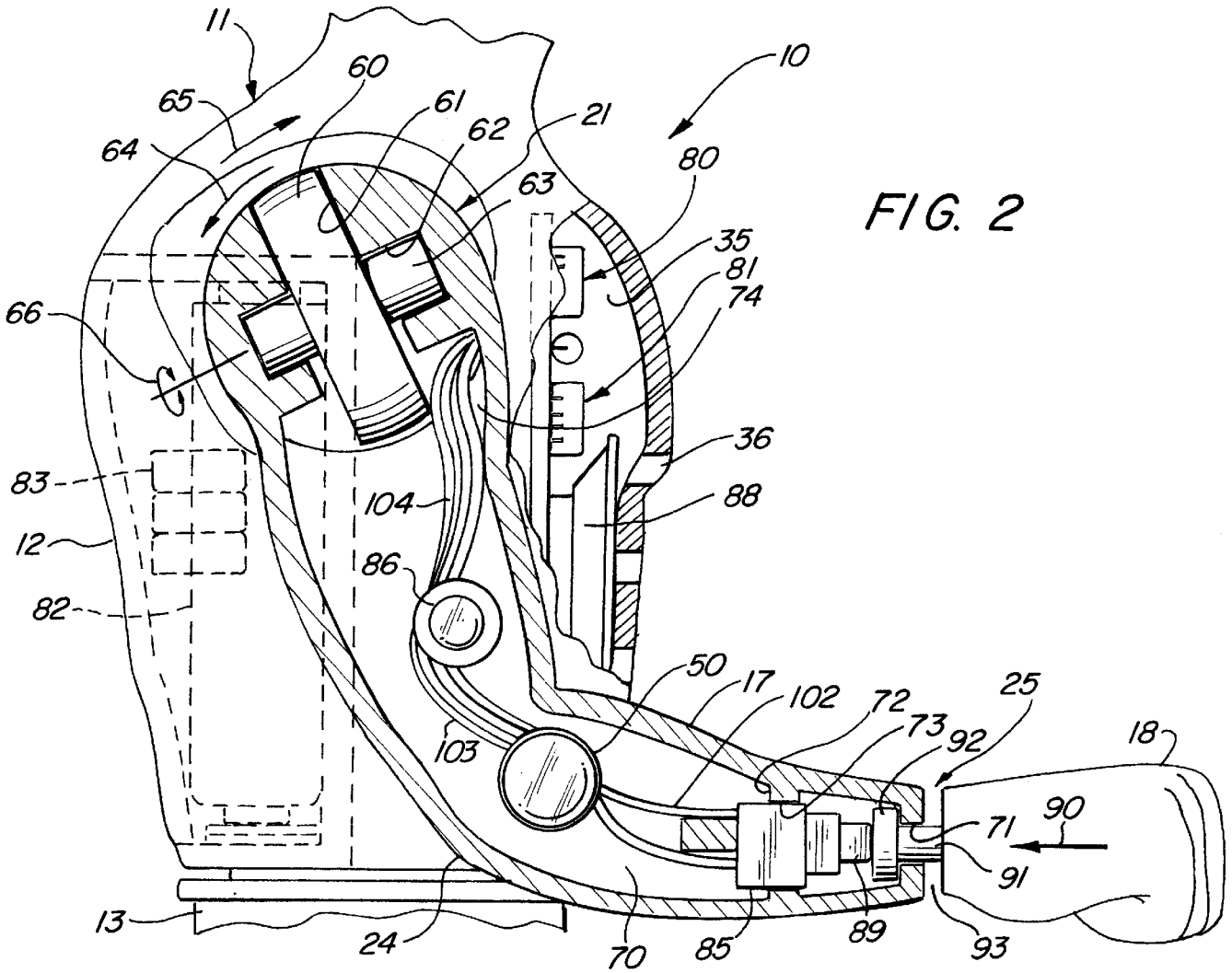
FIG. 2 sets forth a partial section side view of the enhancing feature of the present invention toy action figure.

FIG. 2 sets forth a partial section side view of toy FIG. 10. As described above, toy FIG. 10 includes a body 11 having an upper torso 12 pivotally supported upon a lower torso 13. As is also described above, toy FIG. 10 includes an arm 17 pivotally supported at a shoulder joint 21 upon upper torso 12. The upper shoulder portion of arm 17 defines a slot 16 together with a transversely extending bore 62. A shoulder flange 60 fabricated in accordance with conventional fabrication techniques, defines a generally disk-like object received within slot 61 in a snug friction-fit. In further accordance with conventional fabrication techniques, a cylindrical pin 63 is supported within an aperture (not shown) formed in shoulder flange 60. The ends of pin 63 are received within bore 62 of arm 17. Once again, the preferred fit of pin 63 within bore 62 is a tight friction-fit allowing posability of arm 17. Thus, arm 17 is pivotally movable toward torso 12 or outwardly therefrom in a pivotal movement about pin 63 illustrated as arrows 66. Further, by conventional supports means within torso 12 (not shown), shoulder flange 60 is pivotable at shoulder joint 21 in the directions indicated by arrows 64 and 65.

Arm 17 defines an internal cavity 70 within which a light emitting diode 86 is supported. A flash unit 50 is further supported within interior cavity 70 of arm 17. As mentioned above, arm 17 defines an outer portion which is formed of a clear transparent material illustrated as clear portion 19 shown in FIG. 1. Suffice it to note here, that clear portion 19 is positioned such that light produced by either light emitting diode 86 or flash unit 50 is able to radiate outwardly from interior cavity 70.

Arm 17 further includes an aperture 71 at wrist 25. A wall 72 extends inwardly within arm 17 and defines an aperture 73. An impact switch 85 is supported within aperture 73 and includes an actuating button 89. Hand 18 is preferably formed to resemble a fist in accordance with the above described punching feature. Hand 18 is supported by a rod 91 extending through aperture 71 and terminating within interior 70 in a generally circular flange 92. Flange 92 supports hand 18 against button 89 of impact switch 85. It will be noted that the size of flange 92 and rod 91 is selected to create a space 93 between hand 18 and the end portion of wrist 25. Hand 18 is maintained in the extended position shown in FIG. 2 by the resilient force of impact switch 85 upon button 89. Thus, impact switch 85 will be understood to be a normally open switch which is actuated when button 89 is depressed.

Arm 17 further defines an aperture 74 near shoulder joint 21 through which a plurality of connecting wires 104 are passed into interior cavity 70. Connecting wires 104 are divided to provide electrical connection to light emitting diode 86, flash unit 50 and a pair of wires 102 coupled to impact switch 85. Wires 103 provide the coupling to flash unit 50 and include wires 102.

Toy FIG. 10 further includes an electronic control circuit supported within interior cavity 35 of upper torso 12 which is set forth below in FIG. 4 in greater detail. Suffice it to note here, that the control circuitry within toy FIG. 10 includes a sound circuit 80 and a flash unit 81. By means not shown, sound circuit 80 and flash unit 81 are coupled to wires 104. A speaker 88 is also supported within interior cavity 35 and is positioned against a speaker grille 36 formed in the frontal portion of upper torso 12. Upper torso 12 further supports a plurality of batteries 83 operative to provide power for sound circuit 80 and a plurality of batteries 82 operative to provide power for flash unit 81.

In operation, light emitting diode 86 is energized by flash unit 81 to provide an indication of availability of system operation. Thereafter, an impact against hand 18 moving hand 18 in the direction indicated by arrow 90, depresses button 89 actuating impact switch 885. The actuation of impact switch 85 causes flash unit 81 to activate flash element 50 producing a burst of light energy which travels outwardly through clear portion 19 of arm 17 (seen in FIG. 1). As a result, a bright flash of light is produced each time hand 18 impacts a to-be-punched object or surface. In addition, sound circuit 80 is similarly activated by impact switch 85 causing an audible sound such as a crash or punch sound to be applied to speaker 88. As a result, the high intensity flash of flash element 50 is accompanied by a suitable sound such as a crash or bang sound each time hand 18 is punched against a suitable object or surface.

Figure 3:
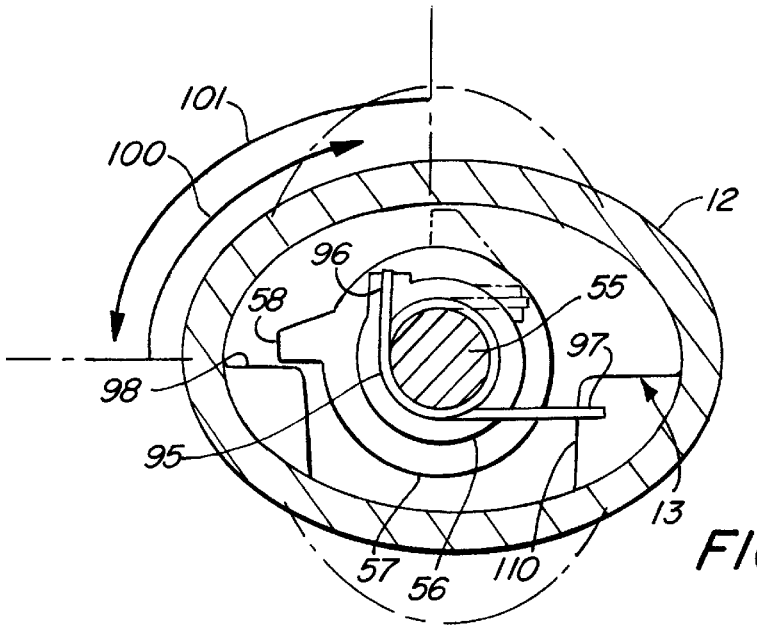
FIG. 3 sets forth a partial section view of the torso pivoting mechanism of the present invention toy action figure.

FIG. 3 sets forth a partial section view of toy FIG. 10 taken along section lines 3—3 in FIG. 1. It will be apparent to those skilled in the art, that the spring powered pivoting mechanism operative between upper torso 12 and lower torso 13 described above may be fabricated entirely in accordance with conventional fabrication techniques. Thus, it will be recognized that toy figures having a twisting upper torso and spring driven return of the type used in the present invention toy figure are well known in the art. Accordingly, the apparatus for providing this twisting and rapidly returning torso movement shown in FIG. 3 will be understood to be illustrative of a variety of equivalent structures which may be utilized without departing from the spirit and scope of the present invention. The essential feature of the pivoting mechanism shown in FIG. 3 or alternative equivalence selected is the ability to rapidly move the upper torso upon the lower torso to impart a swinging or punching motion to arm 17 (seen in FIG. 1).

Thus, upper torso 12 is pivotally supported upon a lower torso 13 by a post 55. Upper torso 12 supports a flange 56 and a plate 57 rotatable along with upper torso 12. Lower torso 13 further includes a spring retainer 110 and a stop member 98. A return spring 95 is wound upon post 55 and includes and end 96 secured to flange 56 of upper torso 12 and an end 97 secured to retainer 110 of lower torso 13. In addition, plate 57 of upper torso 12 includes an outwardly extending stop member 58. Stop members 58 and 98 of upper torso 12 and lower torso 13 cooperate to limit the pivotal movement of upper torso 12 in response to the force of spring 95 to the aligned position shown in FIG. 2.

In operation, the force of spring 95 urges upper torso 12 toward pivotal motion in the direction indicated by arrow 101. This force brings stop member 58 against stop member 98 preventing further pivotal motion and aligning upper torso 12 with lower torso 13. Thereafter, a punching action is initiated by pivoting upper torso 12 against the force of spring 98 in the direction indicated by arrow 100 to the position shown in phantom line depiction. This pivotal movement is approximately ninety degrees. At this point energy has been stored within spring 95. When upper torso 12 is released, the energy stored within spring 95 rapidly pivots upper torso 12 in the direction indicated by arrow 101 causing upper torso 12 to rapidly pivot until stop member 58 again impacts stop member 98. This terminates the pivotal movement of upper torso 12.

Figure 4:
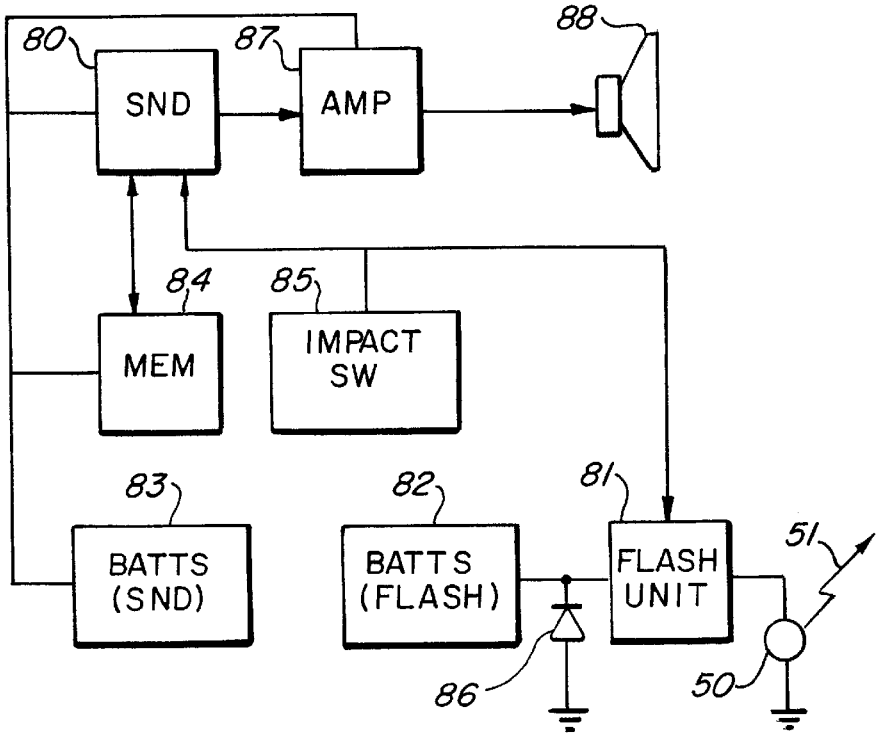
FIG. 4 sets forth a schematic block diagram of the electronic circuit utilized in the present invention toy action figure.

FIG. 4 sets forth a block diagram of the operative circuit within toy FIG. 10. As described above, toy FIG. 10 includes a sound circuit 80 and a flash unit 81. As is also described above, a plurality of batteries 83 are operatively coupled to sound circuit 80 while a separate plurality of batteries 82 are coupled to flash unit 80. A light emitting diode 86 is coupled to flash unit 81 and flash unit batteries 82. A flash element 50 which may, for example, include a is operatively coupled to flash unit 81. An impact switch 85 is coupled to sound circuit 80 and flash unit 81. An audio amplifier 87 is coupled to sound circuit 80 and drives a conventional speaker 88. Speaker 88 is representative of a variety of transducers suitable for converting electrical signals to audible sounds and may, for example, be replaced by a piezoelectric transducer if desired. A memory 84 having a stored combination of digitally encoded sound messages such as crash sounds or the like, is operatively coupled to sound circuit 80.

Sound circuit 80 is fabricated in accordance with conventional fabrication techniques and utilizes memory 84 and the stored audio data therein to provide sound signal output. It will be well understood by those skilled in the art that virtually any speech or sound circuit may be utilized in place of sound circuit 80 and memory 84. The essential characteristic of sound circuit 80 is the provision of appropriate signals to amplifier 87 which in turn are applied to speaker 88 for audiblizing a predetermined message or sound such as a crash sound each time impact switch 85 is actuated. For example, a combination of a microprocessor, read only memory, speech synthesizer and audio output amplifier suitable for the functioning of sound circuit 80, memory 84 and amplifier 87 is fabricated as a single integrated circuit chip device manufactured by Texas Instruments, Inc. under to device name TMS50C44. However, it will be understood that a variety of standard integrated circuit devices may be utilized to provide sound circuit 80, memory 84 and amplifier 87.

Flash unit 81 may be fabricated in accordance with conventional fabrication techniques and provides a triggered voltage surge from batteries 82 for application to flash element 50 each time a signal is received from impact switch 85.

In operation, the circuit of FIG. 4 is silent unit a punch action by FIG. 10 in the manner described above in FIG. 1 takes place. Once the punch action actuates impact switch 85, a signal is applied to sound circuit 80 and flash unit 81. In response to the applied signal from impact switch 85, sound circuit 80 accesses memory 84 to retrieve a stored audible message therefrom which is then converted by sound circuit 80 to appropriate analog audio signals to be applied to amplifier 87. Amplifier 87 increase the power of the applied audio signals to a level sufficient to drive speaker 88 and produce audible sound. By way of example, the present embodiment utilizes a crash-type sound message.

Concurrently, the activation of impact switch 85 and its applied signal to flash unit 81 causes flash unit 81 to transfer of surge of voltage from batteries 82 to flash element 50. In response to the applied voltage, flash element 50 produces a brief high-intensity light flash indicated by arrow 51. Once sound circuit 80 and flash unit 81 have acted, the system remains dormant until the next actuation of impact switch 85. It will be noted that the separate battery-power supplies 83 and 82 used for sound circuit 80 and flash unit 81 may be combined to provide a single battery-power unit without departing from the spirit and scope of the present invention. The use of separate battery-power supplies is employed to allow different operating voltages to be available for sound circuit 80 and flash unit 81. However, this should not be considered a limitation of the present invention.

What has been shown is a novel action toy figure having a punching action which is enhanced by a high intensity light flash upon punch impact together with a crash sound. The action of the bright light flash together with a crash-type sound has been found to greatly enhance the appeal and entertainment value of the punching feature of the toy action figure.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy figure comprising:

a toy figure body having at least one arm, an upper torso and a lower torso, said upper torso being pivotable upon said lower torso between first and second positions;

a spring coupled to said upper and lower torso urging said upper torso toward said first position;

a sound circuit for producing an audible sound;

a flash unit and flash element supported within said at least one arm for producing a burst of light;

a hand movably supported upon said at least one arm; and an impact switch coupled to said sound circuit and said flash unit supported within said at least one arm, said impact switch being actuated by movement of said hand to activate said sound circuit and said flash unit, said upper torso being pivoted against the force of said spring from said first position to said second position and released to rapidly pivot said upper torso and move said at least one arm in a punching motion to impact said hand against an object and actuate said impact switch.

2. The toy figure set forth in claim 1 wherein said at least one arm defines an internal cavity supporting said flash element and wherein said at least one arm defines a light transmissive portion overlying said flash element.

3. The toy figure set forth in claim 2 wherein said at least one arm further includes a light emitting diode coupled to said flash unit operative to indicate an activated state of said flash unit.

4. The toy figure set forth in claim 3 wherein said at least one arm defines a wrest aperture impact switch includes a switch button and wherein said hand includes a rod passing through said wrist aperture and having an end flange said hand moving said rod and said end flange against said switch button when said hand is impacted.

5. The toy figure set forth in claim 4 wherein said at least one arm is pivotably secured to said torso.

6. The toy figure set forth in claim 5 wherein said hand is formed into a fist.

7. A toy figure comprising:

a toy figure body having a lower torso and supporting legs, an upper torso having first and second arms pivotably joined thereto, a pivotably coupling joining said upper torso to said lower torso in a pivotable attachment constructed to allow said upper torso to pivot between first and second positions;

a spring coupled to said upper and lower torsos urging said upper torso toward said first position;

a hand supported upon said first arm;

an impact switch supported within said first arm, said impact switch being activated by an impact to said hand;

a flash unit supported within said torso coupled to an activated by said impact switch;

a flash element supported within said first arm producing a burst of light when energized by said flash unit; and a sound circuit supported within said upper torso and coupled to said impact switch producing an audible sound in response to actuation of said impact switch.

8. A toy figure comprising:

a toy figure body having at least one arm;

a hand supported upon said at least one arm;

an impact switch operative in response to impacts upon said hand;

a flash element supported by said toy figure operative when energized to produce a burst of light; and a flash unit supported by said toy figure body coupled to said impact switch and said flash element energizing said flash element when said impact switch is operative.

9. The toy figure set forth in claim 8 further including sound means coupled to said impact switch operative to produce a sound when said impact switch is operative.

10. The toy figure set forth in claim 9 wherein said at least one arm includes an interior cavity having a light transmissive portion and wherein said flash element is supported within said interior cavity of said at least one arm.

* * * * *